US005622802A

United States Patent [19]

Demizu et al.

[11] Patent Number: 5,622,802

[45] Date of Patent: Apr. 22, 1997

[54] TONER FOR ELECTROSTATIC LATENT IMAGE DEVELOPING

[75] Inventors: Ichiro Demizu, Toyonaka; Yasuki Nagai, Amagasaki; Mitsutoshi Nakamura, Ibaraki; Yukio Tanigami, Amagasaki; Hideaki Ueda, Kishiwada, all of Japan

[73] Assignee: Minolta Co., Ltd., Osaka, Japan

[21] Appl. No.: 488,434

[22] Filed: Jun. 7, 1995

[30] Foreign Application Priority Data

Jun. 13, 1994 [JP] Japan ..... 6-130475

[51] Int. Cl.[6] ..... G03G 9/09

[52] U.S. Cl. ..... 430/106; 430/137

[58] Field of Search ..... 430/137, 106

[56] References Cited

U.S. PATENT DOCUMENTS 4,996,126 2/1991 Anno et al. ..... 430/106.6
5,023,158 6/1991 Tomono et al. ..... 430/99
5,219,694 6/1993 Anno et al. ..... 430/106.6
5,391,456 2/1995 Patel ..... 430/137
5,415,964 5/1995 Hayashi et al. ..... 430/137

FOREIGN PATENT DOCUMENTS 38-2095 3/1963 Japan .

*Primary Examiner*—John Goodrow
*Attorney, Agent, or Firm*—McDermott, Will & Emery

[57] ABSTRACT

A toner for electrostatic latent image developing comprises a binder resin and a coloring agent. The binder resin is preferably a polyester resin having specified properties. The coloring agent is preferably a C. I. Pigment Blue 15-3, C. I. Pigment Red 122 or C. I. Pigment Yellow 17. The toner is prepared by emulsion dispersion of a colored resin solution, including the binder resin and the coloring agent in a non-water soluble organic solvent, in an aqueous dispersion. Subsequently, the non-water soluble organic solvent and the aqueous dispersion are removed to produce fine toner particles, which are washed, dried and sorted to produce the toner.

20 Claims, No Drawings

TONER FOR ELECTROSTATIC LATENT IMAGE DEVELOPING

DETAILED DESCRIPTION OF THE INVENTION

1. Field of the Invention

The present invention concerns a toner for electrostatic latent image developing which is used to develop electrostatic latent images in electronic photography, electrostatic recording and electrostatic printing.

2. Description of the Related Art

A conventional method of producing a toner for electrostatic latent image developing which has been used to develop electrostatic latent images in electronic photography, electrostatic recording and electrostatic printing has been the so-called pulverization method in which a pigment, such as carbon black, is molten kneaded in a thermoplastic resin to form a uniform dispersion, followed by pulverization by a suitable fine pulverization device to produce a toner as a powder of required particle size.

Wet manufacturing methods typified by the suspension polymerization method and the emulsion dispersion method, which produce fine resin particles of small, comparatively uniform particle size, have attracted attention in recent years as substitutes for the pulverization method because of their lower manufacturing costs and higher image quality.

The suspension polymerization method is a method of particle production in which constituents including a monomer and a polymerization initiator are suspended in a dispersion solution and polymerized in order to obtain a polymer.

In addition, the emulsion dispersion method is a method of particle production in which a binding resin formed by a polymer, such as styrene polymer, polyester polymer and epoxy polymer, and a coloring agent are dissolved or dispersed in a suitable organic solvent to form a colored resin solution, followed by the addition of an aqueous dispersion including a water component and vigorous agitation to form liquid droplets of resin solution. That is followed by heating to remove the organic solvent and the water component from said liquid droplets in order to form resin particles.

These wet particle manufacturing methods can adequately cope with higher image quality because they readily form toner particles with a small particle size.

However, the types of monomers which can be used in the aforementioned suspension polymerization method are restricted. For example, polyester resins which are used in a full color toner cannot be used.

The wet particle manufacturing methods have certain disadvantages. For example, a toner prepared by the emulsion dispersion method has restrictions in view of a light permeability, a fixation, a heat resistivity, an offset resistance and a charge characteristics. Especially, a full color toner prepared by the emulsion dispersion method has a poor light permeability.

SUMMARY OF THE INVENTION

In view of the aforementioned circumstances, an object of the present invention is to provide a full-color toner for electrostatic latent image developing with good coloring and outstanding light permeability.

To achieve the aforementioned objects, the present invention provides a toner for electrostatic latent image developing comprising at least a binding resin (also referred to herein as a "binder resin") and a coloring agent dissolved or dispersed in a non-water soluble organic solvent to form a colored resin solution, said toner produced by emulsion dispersion of said colored resin solution in an aqueous dispersion followed by removal of said non-water soluble organic solvent and the aqueous dispersion wherein said toner contains a predetermined pigment as a coloring agent described hereinafter. Further, the present invention's toner contains a polyester resin as a binding resin that has glass transition point Tg of 50° to 70° C., numerical average molecular weight Mn of 2,500 to 12,000, or molecular weight distribution represented by ratio of weight average molecular weight Mw to Mn (Mw/Mn) of 2 to 6 in addition to the prescribed pigment as the coloring agent.

Specifically, the inventors focused their attention on the ability to use polyester resin as the binding resin in the emulsion dispersion method, and found that a full-color toner with good coloring and outstanding light permeability could be obtained by specifying the properties of the resin and the coloring agent in the emulsion dispersion method. That discovery completed the present invention.

The invention is also directed to a method for producing a toner for electrostatic latent image developing, comprising the steps of:

a. dissolving a binder resin and a coloring agent, selected from the group consisting of C. I. Pigment Blue 15-3, C. I. Pigment Red 122 and C.I. Pigment Yellow 17, in a non-water soluble organic solvent to form a colored resin solution;

b. emulsion dispersing the colored resin solution in an aqueous dispersion including a water component;

c. removing the non-water soluble organic solvent; and d. removing said water component.

Another embodiment of the invention is directed to the toner, preferably a full-color toner, for electrostatic latent image developing produced by a method comprising the steps of:

a. dissolving or dispersing a binder resin and a coloring agent in a non-water soluble organic solvent to form a colored resin solution, the coloring agent being selected from the group consisting of C. I. Pigment Blue 15-3, C. I. Pigment Red 122 and C. I. Pigment Yellow 17;

b. emulsion dispersing the colored resin solution in an aqueous dispersion, including a water component, to form an oil-in-water (O/W) emulsion;

c. removing the non-water soluble organic solvent from the O/W emulsion; and d. removing said water component.

Yet another embodiment of the invention is directed to a toner, preferably a full-color toner, for electrostatic image developing comprising a polyester binder resin and a coloring agent selected from the group consisting of C. I. Pigment Blue 15-3, C. I. Pigment Red 122 and C. I. Pigment Yellow 17.

As pointed out in greater detail below, the toner of this invention provides important advantages. The toner has very good ambient fluctuation in the amount of charge, heat resistance, offset resistance, light permeability, fixation properties, and other properties. This becomes particularly noticeable when the toner of the invention is compared to comparative toners made with binder resins, coloring agents and/or using method parameters falling outside those specified for this invention.

DESCRIPTION OF THE PREFERRED EMBODIMENTS

A polyester resin having glass transition point (Tg) of 50° to 70° C., preferably 55° to 70° C., numerical average molecular weight (Mn) of 2,500 to 12,000, preferably 3,000 to 10,000, and molecular weight distribution represented by the ratio of weight average molecular weight Mw to Mn (Mw/Mn) of 2 to 6 is used as the binding resin in the present invention. The heat resistance of the resulting toner declines when the glass transition point Tg is under 50° C. while the fixation of the resulting toner declines if Tg exceeds 70° C. Furthermore, high-temperature offset readily occurs in the resulting toner if average molecular weight Mn falls below 2,500 while the light permeability deteriorates if it exceeds 12,000. Finally, the non-offset region is restricted if the ratio Mw/Mn falls below 2 in oil application fixation, and the light permeability deteriorates if it exceeds 6.

The fixation (or the coloring agents) used in the present invention includes C. I. Pigment Blue 15-3, C. I. Pigment Red 122 and C. I. Pigment Yellow 17. These are organic pigments with good color development, comparatively good dispersion of binding resin and organic solvent, and little flocculation. Accordingly, the toner coloring is good, the color reproduction is broad, and the light permeability is good.

The amount of these coloring agents used should be 1 to 20 parts-by-weight per 100 parts-by-weight of the binding resin contained in the toner, preferably 2 to 15 parts-by-weight. The toner fixation declines when the amount of the coloring agent exceeds 20 parts-by-weight while desired image consistency is not attained if it falls below 1 part-by-weight.

A toner in which the coloring agent is adequately and uniformly dispersed in the resin can be obtained by producing the toner through the emulsion dispersion method using such resins and coloring agents.

Any organic solvent may be used as the non-water soluble organic solvent for the dissolution of the aforementioned polyester resin so long as it is insoluble or has low solubility in water. Examples of such solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone which are used alone or in combinations of two or more. Aromatic solvents, such as toluene and xylene, and halogenated hydrocarbons, such as methylene chloride, 1,2-dichloroethane, chloroform and carbon tetrachloride are preferable.

Charge controlling agents which can be used include white charge controlling agents for color toner. Suitable examples include metal complexes, such as Pontron E-81 (a product of Orient Chemical Industries, Ltd.) and Pontron E-84, calyx allene compounds, such as Pontron E-89 (a product of Orient Chemical Industries, Ltd.), boron compounds such as LR-147 (a product of Nihon Carlit Co., Ltd.) and cayacharge N-1, N-3, N-4 (product of Nippon Kayaku Co., Ltd.).

The amount of these charge controlling agents which is added should be 0.1 to 5 parts-by-weight per 100 parts-by-weight of the binding resin contained in the toner, preferably 0.1 to 3 parts-by-weight. Adequate charging performance is not attained if the content of the charge controlling agent falls below 0.1 part-by-weight while the charge controlling agent is readily spent in print resistance and the amount of charge falls if the content exceeds 5 parts-by-weight.

Constituents such as magnetic powder and offset inhibitor may be blended in the toner for electrostatic latent image developing of the present invention as required in addition to the aforementioned binding resin, coloring agent and charge controlling agent.

Suitable examples of the magnetic powder include magnetite, γ-hematite and various types of ferrite.

Suitable offset inhibitors include various types of wax, especially low molecular weight polypropylene, polyethylene as well as polyolefin wax including oxide type polypropylene and polyethylene.

The aforementioned toner constituents, specifically, the binding resin, coloring agent as well as the charge controlling agent, the magnetic powder and the offset inhibitor, as required, are dissolved or dispersed in the aforementioned non-water soluble organic solvent in the present invention, and the resulting colored resin solution is emulsion dispersed in the aqueous dispersion to form an oil-in-water (O/W) emulsion. Subsequently, the non-water soluble organic solvent is removed from said O/W emulsion to complete the production of fine resin particles. The aqueous dispersion is also removed in any suitable manner, such as heating and decompressing. Said fine resin particles are washed, dried and sorted as required to form the toner for electrostatic latent image developing of small particle size with average particle diameter of 4 to 10 μm. O/W emulsion denotes a suspension in which oily liquid forms droplets that are dispersed in the aqueous dispersion.

Common devices including the ball mill, sand grinder, and ultrasonic homogenizer may be used in dissolution and dispersion of toner constituents in the non-water soluble organic solvent.

The solid-fraction concentration in said colored resin solution must be set so that liquid droplets readily solidify on fine particles following removal of the non-water soluble organic solvent from liquid droplets by heating an O/W emulsion in which said colored resin solution is emulsion dispersed in the aqueous dispersion. Said solid-fraction concentration should be 5 to 50 percent-by-weight, preferably 10 to 40 percent-by-weight.

A stirring device, such as a homomixer, is used to form an O/W emulsion, and a method of adequate stirring of a mixed system comprising the colored resin solution and the aqueous dispersion may be employed. The stirring time should be no less than 10 minutes since a sharp particle size distribution is not obtained if the stirring time is too short.

The ratio of volume (Vp) of the colored resin solution to volume (Vw) of the aqueous dispersion should be in a range of $Vp/Vw \leqq 1$, preferably $0.3 \leqq Vp/Vw \leqq 0.7$. Specifically, a stable O/W emulsion cannot be formed if $Vp/Vw > 1$ because phase transition readily occurs during the process or a W/O emulsion tends to form.

Permissible aqueous dispersions which are used to form an O/W emulsion include water or dispersions in water containing a water-soluble organic solvent such that an emulsion is not destroyed. Examples include water/methanol mixed solution (weight ratio 50/50 to 100/0), water/ethanol mixed solution (weight ratio 50/50 to 100/0), water/acetone mixed solution (weight ratio 50/50 to 100/0), and water/methyl ethyl ketone mixed solution (weight ratio 70/30 to 100/0).

Dispersion stabilizers and dispersion stabilizer auxiliary agents may be added as required to the aqueous dispersion.

The dispersion stabilizers contain hydrophilic colloids in the aqueous dispersion. Examples include gelatin, acacia, agar, cellulose derivatives including hydroxymethyl cellulose, hydroxyethyl cellulose, and hydroxypropyl cellulose, and synthetic macromolecules including polyvinyl alcohol, polyvinyl pyrrolidone, polyacrylamide, polyacrylate and polymethacrylate. In addition, calcium phosphates having low solubility in water may also be used. The cleaning properties of the toner can be enhanced since irregular particles can be obtained when calcium phosphates are used as the dispersion stabilizer.

Suitable examples of calcium phosphates include tricalcium phosphate, calcium diphosphate and hydroxycalcium phosphate. These calcium phosphates may adopt the form of a double salt with calcium fluoride and calcium chloride.

Natural surfactants, such as saponin, nonionic surfactants, such as alkylene oxide, glycerol, glycidol, and anionic surfactants containing acidic radicals, such as carboxylic acid, sulfonic acid, phosphoric acid, sulfate ester radicals and phosphate ester radicals are examples of the dispersion stabilizer auxiliary agents. In particular, anionic surfactants, such as dodecyl benzene sodium sulfonate or sodium lauryl sulfate, are preferable when calcium phosphates are used as the dispersion stabilizer, and anionic surfactants are preferable when polyvinyl alcohol is used as the dispersion stabilizer.

After an O/W emulsion has been formed in the aforementioned manner, the temperature of the entire system may be gradually raised to completely remove the non-water soluble organic solvent from said liquid droplets to form fine toner particles. In another example, an O/W emulsion may be sprayed in a drying atmosphere to completely remove the non-water soluble organic solvent from liquid droplets to form fine toner particles, followed by evaporation removal of the water-based dispersant. The drying atmosphere in which the O/W emulsion is sprayed may be air, nitrogen, carbon dioxide or exhaust gas which is heated to a temperature of 20° C. to 250° C. Various types of gaseous streams which have been heated to a temperature above the boiling point of the non-water soluble organic solvent with the highest boiling point would generally be employed.

When calcium phosphates are used as the dispersion stabilizer, they would be removed from fine particles by washing with water following dissolution of calcium phosphates using acids, such as hydrochloric acid.

The present invention is explained in more detail below with the aid of the following examples. All references to parts below are based on weight.

Example of Producing a Polyester Resin 1

Polyoxyethylene (2)-2,2-bis (4-hydroxyphenyl) propane (68 parts), isophthalic acid (16 parts), terephthalic acid (16 parts) and dibutyl tin oxide (0.06 part) were packed in a flask, reacted for 24 hours in a nitrogen atmosphere at 230° C. and removed to produce polyester resin 1 having numerical average molecular weight (Mn) of 4.400, Mw/Mn of 3.5, melt viscosity of $3\times10^4$ poise at 100° C. and glass transition point (Tg) of 60° C.

The melt viscosity was measured using a flow tester CFT-500 (product of Shimadzu Seisakusho, Ltd.) at a heating rate of 3° C./min, 30 kg load, and 1 mm nozzle length, 1 mm nozzle diameter.

The Tg was measured using a differential scanning calorimeter (SSC 570; product of Seiko Electronic Industries, Ltd.). Concretely, it was determined from the temperature at the intersection of the baseline of a chart measured at a heating rate of 10° C./min and the tangent of the endothermic curve near the glass transition point.

The molecular weight was measured through gel permeation chromatography using tetrahydrofuran as a solvent, a commercial polystyrene gel column and a refractiva index detector for detection.

Examples of Producing Polyester Resins 2 to 13

The reaction in the example of producing the polyester resin 1 was carried out while measuring the acid value, and polyester resins 2 to 13 shown in Table 1 were obtained by terminating the reaction at the point when the acid value corresponding to the prescribed molecular weight was attained.

TABLE 1

| Name of resin (Polyester resin) | Glass transition Tg (C.°) | Ave. molecular weight (Mn) | Mw/Mn |
|---|---|---|---|
| #1 | 60 | 4400 | 3.5 |
| #2 | 62 | 11500 | 4.5 |
| #3 | 57 | 2500 | 2.4 |
| #4 | 56 | 4000 | 2.0 |
| #5 | 64 | 3800 | 5.5 |
| #6 | 52 | 3500 | 3.3 |
| #7 | 70 | 4200 | 3.8 |
| #8 | 55 | 2000 | 2.5 |
| #9 | 65 | 13000 | 5.2 |
| #10 | 52 | 2900 | 1.8 |
| #11 | 66 | 4000 | 6.3 |
| #12 | 47 | 4200 | 3.1 |
| #13 | 73 | 5300 | 4.5 |

EMBODIMENT 1

Example of Producing Cyan Toner 1

The polyester resin 1 (100 parts), copper phthalocyanine blue pigment (C. I. Pigment Blue 15-3; product of Toyo Ink Co., Ltd.) (6 parts) and salicylic acid complex (Pontron E-84; product of Orient Chemical Industries, Ltd.) (2 parts) were added to 400 parts of toluene, processed for 30 minutes using an ultrasonic homogenizer (400 μA output), and a resin solution was prepared through dissolution/dispersion.

In addition, sodium lauryl sulfate (product of Wako Pure Chemical Industries, Ltd.) (0.1 part) was dissolved in 1000 parts of 4 percent-by-weight hydroxycalcium phosphate as a dispersion stabilizer in the preparation of an aqueous dispersion.

The aforementioned colored resin solution (50 parts) was added slowly to said aqueous dispersion (100 parts) while it was stirred at 4000 rpm using a TK homomixer (a product of Tokushu Kika Industries, Ltd.), and a suspension of liquid droplets with average particle diameter of 6 μm was prepared. This was stored for 5 hours at 60° C., 100 mmHg to remove toluene from liquid droplets, followed by dissolution of calcium phosphate using concentrated hydrochloric acid. Filtration and water washing were repeated thereafter, followed by particle drying at 80° C. using a slurry drying device (Disbarcoat: product of Nissei Engineering Co., Ltd.) to produce cyan toner 1 having average particle diameter of 6.0 μm.

EMBODIMENT 2

Example of Producing Cyan Toner 2

Cyan toner 2 having average particle diameter of 6.2 μm was obtained using the same procedures as were used in Embodiment 1 except for the use of 2 parts of calyx allene compound (Pontron E-89; product of Orient Chemical Industries, Ltd.) instead of salicylic acid complex.

EMBODIMENT 3

Example of Producing Cyan Toner 3

Cyan toner 3 having average particle diameter of 5.8 μm was obtained using the same procedures as were used in Embodiment 1 except for the use of 2 parts of a boron compound (LR-147; product of Nihon Carlit Co., Ltd.) instead of salicylic acid complex.

EMBODIMENTS 4–9

Example of Producing Cyan Toners 4–9

Cyan toners 4–9 having average particle diameter of 5.8 μm were obtained using the same procedures as were used in Embodiment 1 except for the use of polyester resins 2 to 7 instead of polyester resin 1.

EMBODIMENTS 10–18

Examples of Producing Magenta Toners 1 to 9

Magenta toners 1–9 having average particle diameter of 6.1 μm were obtained using the same procedures as were used in Embodiments 1 to 9 except for the use of C. I. Pigment Red 122 instead of C. I. Pigment Blue 15-3.

EMBODIMENTS 19–27

Examples of Producing Yellow Toners 1 to 9

Yellow toners 1–9 having average particle diameter of 6.1 μm were obtained using the same procedures as were used in Embodiments 1 to 9 except for the use of C. I. Pigment Yellow 17 instead of C. I. Pigment Blue 15-3.

EXAMPLES 1 TO 6

Examples of Producing Cyan Toners 10 to 15

Cyan toners 10 to 15 having average particle diameter of 5.8 μm were obtained using the same procedures as were used in Embodiment 1 except for the use of polyester resins 8 to 13 instead of polyester resin 1.

COMPARATIVE EXAMPLE 7

Example of Producing Cyan Toner 16

Cyan toner 16 having average particle diameter of 6.1 μm was obtained using the same procedures as were used in Embodiment 1 except for the use of ultramarine inorganic pigment instead of C. I. Pigment Blue 15-3.

COMPARATIVE EXAMPLES 8 TO 13

Examples of Producing Magenta Toners 10 to 15

Magenta toners 10 to 15 having average particle diameter of 6.1 μm were obtained using the same procedures as were used in Comparative Examples 1 to 6 except for the use of C. I. Pigment Red 122 instead of C. I. Pigment Blue 15-3.

COMPARATIVE EXAMPLE 14

Example of Producing Magenta Toner 16

Magenta toner 16 having average particle diameter of 6.1 μm was obtained using the same procedures as were used in Embodiment 1 except for the use of brilliant carmine 6B instead of C. I. Pigment 15-3.

COMPARATIVE EXAMPLE 15 To 20

Examples of Producing Yellow Toners 10 to 15

Yellow toners 10 to 15 having average particle diameter of 6.1 μm were obtained using the same procedures as were used in Comparative Examples 1 to 6 except for the use of C. I. Pigment Yellow 17 instead of C. I. Pigment 15-3.

COMPARATIVE EXAMPLE 21

Example of Producing Yellow Toner 16

Yellow toner 16 having average particle diameter of 6.1 μm was obtained using the same procedures as were used in Embodiment 1 except for the use of yellow iron sulfate as inorganic pigment instead of C. I. Pigment Blue 15-3.

Example of Producing Carrier 1

A styrene-acrylic resin solution having a solid fraction proportion of 2 percent-by-weight was prepared by diluting styrene-acrylic copolymer (1.5:7:1.0:0.5) comprising styrene, methyl methacrylate, 2-hydroxyethyl acrylate and methacrylic acid (80 parts) and butylated melamine resin (20 parts) with toluene.

The aforementioned styrene-acrylic resin solution was applied using a spiracoater (product of Okada Seiko K. K.) to a core of calcined ferrite powder F-300 having average particle diameter 50 μm, bulk density 2.53 g/cm$^3$ (product of Powdertech Inc.), and dried. The resulting carrier was calcined by setting it in a hot-air circulating oven at 140° C. for 2 hours. After cooling, bulk ferrite powder was disintegrated using a sieve fitted with screen mesh of 210 μm by 90 μm, to form a resin-coated ferrite powder. Said resin coated ferrite powder was subjected to the steps of coating, calcination and disintegration three times each to produce a resin coated carrier. The average particle diameter of the carrier 1 was 52 μm and the electrical resistance was $3\times10^{10}$ Ωcm.

Example of Producing Carrier 2

Resin coated carrier 2 having average particle diameter of 50 μm and electrical resistance of approximately $1\times10^{10}$ Ωcm was obtained using the same procedures as were used in the production example of carrier 1 using resin solution with a solid fraction ratio of 2 percent-by-weight which was prepared by diluting 100 parts-by-weight of silicone-modified vinyl copolymer.

Example of Producing Carrier 3

Polyester resin (NE-1110; product of Kao Corporation) (100 parts), magnetic powder (EPT-1000; product of Ashida Industries, Ltd.) (500 parts) and carbon black (MA#8; product of Mitsubishi Chemical Industries Ltd.) (2 parts) were adequately mixed using a Henschel mixer, followed by molten kneading using an extruding mixer with cylinder temperature set at 180° C. and cylinder head temperature set at no less than 170° C. The resulting kneaded mixture was cooled, followed by crude pulverization using a phaser mill, fine pulverization using a jet mill, and sorting using a pneumatic sorter to produce carrier 3 having average particle diameter of 55 μm.

Evaluation of Various Characteristics

The various characteristics of the toner presented below from embodiments and comparative examples obtained in the aforementioned manner were evaluated.

(1) Heat resistance

The degree of toner flocculation following storage for 24 hours at 50° C. of toner (5 g) which had been cast into a 50 cc glass bottle was observed visually and was evaluated based on the following standards.

O: No flocculation of toner developed.

Δ: Some flocculation of toner developed, but it broke up upon shaking of the bottle so as to pose no practical problem.

X: All of the toner flocculated, and the flocculation did not break up even after shaking, which made it useless in practice.

(2) Evaluation of resistance to offset properties

Silica (0.3 part) (H-2000: product of Walker, Inc.) and hydrophobic titanium oxide (0.5 part) (T-805: product of Nihon Aerogel Co., Ltd.) were added to 100 parts of toner from the aforementioned embodiments and comparative examples, followed by treatment for 1 minute at 1000 rpm using a Henschel mixer (product of Mitsui Sanke Chemical Industries, Ltd.). The individual toners and carriers were then mixed at a 5:95 weight ratio to produce developer for evaluation. That was followed by the use of carrier 1 in toners of Embodiments 1 to 27 and Comparative Examples 1 to 21, carrier 2 in cyan toner 1 of Embodiment 28 and carrier 3 in cyan toner 1 of Embodiment 29.

The aforementioned developers which were prepared using the toners of Embodiments 1 to 29 and Comparative Examples 1 to 21 were used in a commercial full-color copier CF-70 (product of Minolta Camera Co., Ltd.) to form images at normal temperature, normal humidity (25° C., 60%). The offset resistance was evaluated by visually confirming the presence of offset properties on fixation rollers.

The offset resistance was evaluated similarly to the aforementioned method using cyan toner 1 as a single-constituent toner without using carrier of the toner of Embodiment 30. It was evaluated by attaching an application mechanism to a commercial electronic photoprinter SP101 (product of Minolta Camera Co., Ltd.). The evaluation standards were established as follows.

O: Absolutely no offset on fixation rollers.

Δ: Offset developed on fixation rollers, but it had no effect on the image quality on paper x: Offset developed on fixation rollers and it affected the image quality on paper.

(3) Evaluation of fixation

A solid with ID value of 1.2 was developed through the same procedures as were used in evaluation of the offset resistance and was fixed on copy paper (EP paper made by Minolta Camera Co., Ltd.). Solid with ID value was measured through a color filter in order to compensate for toner's color such as cyan, magenta and yellow. A measured toner image was formed to be a dot image which has a diameter of 5 mm. A smooth eraser which was laid on the fixed image was rubbed six times with a load of 1 kg applied. The image consistency before and after rubbing was measured, and the proportion of image consistency after rubbing versus the image consistency before rubbing was computed. The fixation was evaluated using the following standards. O and Δ represent passing ratings.

O: No less than 80%

Δ: 60 to 80% x: Under 60%

(4) Evaluation of light permeability

An image was formed on light permeable film through the same procedures as were used in evaluation of the offset resistance so that the amount of toner adhering per developer would be uniform. It was then visually evaluated through the following standards.

O: Adequate light permeability was attained.

Δ: Some color darkening developed but not enough to cause practical problems.

x: Color discrimination was difficult.

(5) Evaluation of ambient fluctuation of amount of charge

The amount of charge ($Q_{LL}$) of a developer which had been prepared using the toner of Embodiments 1 to 29 and of Comparative Examples 1 to 21 and had been set in a low-temperature, low-humidity environment (10° C., 15% humidity) and stored for 24 hours, and the amount of charge ($Q_{HH}$) following storage for 24 hours in a high-temperature, high-humidity environment (30° C., 85% humidity) were measured. The amount of charge was measured by casting 30 g of the developer into a 50 ml volume polyethylene bottle, rotation for 10 minutes at 1200 rpm to agitate the developer, bringing it into contact with film which had a prescribed charge, and measuring the toner weight adhering to the film in a normal-temperature, normal-humidity environment (25° C., 60% humidity). The difference was taken as the ambient fluctuation ΔQ of the amount of charge. Specifically, $\Delta Q = Q_{LL} - Q_{HH}$. The ambient fluctuation of the amount of charge was evaluated by the following ranking.

O: $\Delta Q < 10$

Δ: $10 \leqq \gamma Q \leqq 15$ x: $\Delta Q > 15$ (6) Measurement of the amount of toner with poor charge Developer (30 g) prepared using the toner of Embodiments 1 to 29 and of Comparative Examples 1 to 21 was cast into a 50 ml volume polyethylene bottle, rotated for 10 minutes at 1200 rpm to agitate the developer, followed by laying 3 g of the developer on a magnetic roll of 310 mm diameter. An opposing electrode which had been precisely weighed was then set, bias voltage of 1 kV with opposite polarity from that of the toner was applied, and the magnetic roller was rotated for 1 minute at 1000 rpm. The opposing electrode was then carefully reweighed, and the difference from the initial value was taken to compute the amount of liberated toner which adhered to the opposing electrode, specifically, the weight of the toner with poor charge. In this manner, the proportion of the weight of the toner with poor charge to the total toner weight which had been supplied for measurement could be taken as the weight of the toner with poor charge. The evaluation standards were determined in the following manner. O and Δ represent passing ratings.

O: Amount of the toner with poor charge under 1.0%.

Δ: Amount of the toner with poor charge 1.0% to 2.0%.

x: Amount of the toner with poor charge above 2.0%.

The results of the aforementioned measurements are summarized in Tables 2 and 3.

TABLE 2

| | Amount of toner with poor charge | Change in amount of charge | Offset resistance | Heat resistance | Fixation | Light permeability | Toner | Carrier |
|---|---|---|---|---|---|---|---|---|
| Emb 1 | ○ | ○ | ○ | ○ | ○ | ○ | Cyan toner 1 | Carrier 1 |
| Emb 2 | ○ | ○ | ○ | ○ | ○ | ○ | ↑ 2 | ↑ |
| Emb 3 | ○ | ○ | ○ | ○ | ○ | ○ | ↑ 3 | ↑ |
| Emb 4 | ○ | ○ | ○ | ○ | ○ | Δ | ↑ 4 | ↑ |
| Emb 5 | ○ | ○ | Δ | ○ | ○ | ○ | ↑ 5 | ↑ |
| Emb 6 | ○ | ○ | Δ | ○ | ○ | ○ | ↑ 6 | ↑ |
| Emb 7 | ○ | ○ | ○ | ○ | ○ | Δ | ↑ 7 | ↑ |
| Emb 8 | ○ | ○ | ○ | Δ | ○ | ○ | ↑ 8 | ↑ |
| Emb 9 | ○ | ○ | ○ | ○ | | ○ | ↑ 9 | ↑ |
| Emb 10 | ○ | ○ | ○ | ○ | ○ | ○ | Magenta toner 1 | ↑ |
| Emb 11 | ○ | ○ | ○ | ○ | ○ | ○ | ↑ 2 | ↑ |
| Emb 12 | ○ | ○ | ○ | ○ | ○ | ○ | ↑ 3 | ↑ |
| Emb 13 | ○ | ○ | ○ | ○ | ○ | Δ | ↑ 4 | ↑ |
| Emb 14 | ○ | ○ | Δ | ○ | ○ | ○ | ↑ 5 | ↑ |
| Emb 15 | ○ | ○ | Δ | ○ | ○ | ○ | ↑ 6 | ↑ |
| Emb 16 | ○ | ○ | ○ | ○ | ○ | Δ | ↑ 7 | ↑ |
| Emb 17 | ○ | ○ | ○ | Δ | ○ | ○ | ↑ 8 | ↑ |
| Emb 18 | ○ | ○ | ○ | ○ | Δ | ○ | ↑ 9 | ↑ |
| Emb 19 | ○ | ○ | ○ | ○ | ○ | ○ | Yellow toner 1 | ↑ |
| Emb 20 | ○ | ○ | ○ | ○ | ○ | ○ | ↑ 2 | ↑ |
| Emb 21 | ○ | ○ | ○ | ○ | ○ | ○ | ↑ 3 | ↑ |
| Emb 22 | ○ | ○ | ○ | ○ | ○ | Δ | ↑ 4 | ↑ |
| Emb 23 | ○ | ○ | Δ | ○ | ○ | ○ | ↑ 5 | ↑ |
| Emb 24 | ○ | ○ | Δ | ○ | ○ | ○ | ↑ 6 | ↑ |
| Emb 25 | ○ | ○ | ○ | ○ | ○ | Δ | ↑ 7 | ↑ |
| Emb 26 | ○ | ○ | ○ | Δ | ○ | ○ | ↑ 8 | ↑ |
| Emb 27 | ○ | ○ | ○ | ○ | Δ | ○ | ↑ 9 | ↑ |
| Emb 28 | ○ | Δ | ○ | ○ | ○ | ○ | Cyan toner 1 | Carrier 2 |
| Emb 29 | ○ | ○ | ○ | ○ | ○ | ○ | ↑ | Carrier 3 |
| Emb 30 | —(unmeas-urable) | —(unmeas-urable) | ○ | ○ | ○ | ○ | ↑ | — |

TABLE 3

| | Amount of toner with poor charge | Change in amount of charge | Offset resistance | Heat resistance | Fixation | Light permeability | Toner | Carrier |
|---|---|---|---|---|---|---|---|---|
| Comp. Ex 1 | ○ | ○ | X | ○ | ○ | ○ | Cyan toner 10 | Carrier 1 |
| Comp. Ex 2 | ○ | ○ | ○ | ○ | ○ | X | ↑ 11 | ↑ |
| Comp. Ex 3 | ○ | ○ | X | Δ | ○ | ○ | ↑ 12 | ↑ |
| Comp. Ex 4 | ○ | ○ | ○ | ○ | ○ | X | ↑ 13 | ↑ |
| Comp. Ex 5 | ○ | ○ | ○ | X | ○ | ○ | ↑ 14 | ↑ |
| Comp. Ex 6 | ○ | ○ | ○ | ○ | X | ○ | ↑ 15 | ↑ |
| Comp. Ex 7 | X | X | ○ | ○ | ○ | X | ↑ 16 | ↑ |
| Comp. Ex 8 | ○ | ○ | X | ○ | ○ | ○ | Magenta toner 10 | ↑ |
| Comp. Ex 9 | ○ | ○ | ○ | ○ | ○ | X | ↑ 11 | ↑ |
| Comp. Ex 10 | ○ | ○ | X | Δ | ○ | ○ | ↑ 12 | ↑ |
| Comp. Ex 11 | ○ | ○ | ○ | ○ | ○ | X | ↑ 13 | ↑ |
| Comp. Ex 12 | ○ | ○ | ○ | X | ○ | ○ | ↑ 14 | ↑ |
| Comp. Ex 13 | ○ | ○ | ○ | ○ | X | ○ | ↑ 15 | ↑ |
| Comp. Ex 14 | Δ | Δ | ○ | ○ | ○ | X | ↑ 16 | ↑ |
| Comp. Ex 15 | ○ | ○ | X | ○ | ○ | ○ | Yellow toner 10 | ↑ |
| Comp. Ex 16 | ○ | ○ | ○ | ○ | ○ | X | ↑ 11 | ↑ |
| Comp. Ex 17 | ○ | ○ | X | Δ | ○ | ○ | ↑ 12 | ↑ |
| Comp. Ex 18 | ○ | ○ | ○ | ○ | | X | ↑ 13 | ↑ |
| Comp. Ex 19 | ○ | ○ | ○ | X | ○ | X | ↑ 14 | ↑ |
| Comp. Ex 20 | ○ | ○ | ○ | ○ | X | ○ | ↑ 15 | ↑ |
| Comp. Ex 21 | X | X | ○ | ○ | ○ | X | ↑ 16 | ↑ |

The embodiments described above provide a number of significant advantages. As Table 2 shows, the toner of the embodiments of the invention had average particle diameter of 6 μm, and exhibited satisfactory performance in terms of light permeability, ambient fluctuation in amount of charge, offset resistance properties, heat resistance, and fixation. In contrast, the toner of the comparative examples was not satisfactory in any of the aforementioned evaluation items, as shown in Table 3.

As explained above, the present invention provides the toner for electrostatic latent image developing which is produced by dissolving or dispersing toner constituents comprising at a least a binding resin, a coloring agent and a charge controlling agent in a non-water soluble organic solvent to form a colored resin solution, followed by emulsion dispersion of said colored resin solution in an aqueous dispersion, removal of said non-water soluble organic solvent and the aqueous dispersion and drying. Since said toner contains the polyester resin with prescribed physical properties and the specific organic pigment, a full-color toner with good coloring and outstanding light permeability can be produced even when the small particle size has been reduced.

Of course, it should be understood that a wide range of changes and modifications can be made to the embodiments described above. It is therefore intended that the foregoing detailed description be regarded as illustrative rather than limiting, and that it be understood that it is the following claims, including all equivalents, which are intended to define the scope of this invention.

What is claimed is:

1. A toner for electrostatic latent image developing comprising a binder resin and a color agent selected from the group consisting of C. I. Pigment Blue 15-3, C. I. Pigment Red 122 and C. I. Pigment Yellow 17, said toner being produced by emulsion dispersion of a colored resin solution comprising the binder resin, the coloring agent and a non-water soluble organic solvent in an aqueous dispersion including a water component followed by removal of said non-water soluble organic solvent and said water component.

2. A toner of claim 1 wherein said binder resin is a polyester resin having a glass transition point Tg of 50° to 70° C., a numerical average molecular weight Mn of 2,500 to 12,000, a molecular weight distribution represented by a ratio of weight average molecular weight Mw to Mn (Mw/Mn) of 2 to 6.

3. A method for producing a toner for electrostatic latent image developing comprising the steps of:

a. preparing a colored resin solution comprising a binder resin, a non-water soluble organic solvent and a coloring agent selected from the group consisting of C. I. Pigment Blue 15-3, C. I. Pigment Red 122 and C. I. Pigment Yellow;

b. emulsion dispersing the colored resin solution in an aqueous dispersion including a water component;

c. removing the non-water soluble organic solvent; and d. removing said water component.

4. A method of claim 3 wherein said binder resin is a polyester polymer having a glass transition point Tg of 50° to 70° C., a numerical average molecular weight Mn of 2,500 to 12,000, a molecular weight distribution represented by a ratio of weight average molecular weight Mw to Mn (Mw/Mn) of 2 to 6.

5. A toner of claim 2 wherein said toner further comprises a metal complex of salicylic acid compound as a charge control agent which is added in amount of 0.1 to 5 parts by weight per 100 parts by weight of the binder resin, and said coloring agent added in amount of 1 to 20 parts by weight per 100 parts by weight of the binder resin.

6. A toner of claim 2 further comprising a calix arene compound as a charge control agent which is added in amount of 0.1 to 5 parts by weight per 100 parts by weight of the binder resin, wherein said coloring agent is added in amount of 1 to 20 parts by weight per 100 parts by weight of the binder resin.

7. A toner of claim 2 further comprising a boron compound as a charge control agent which is added in amount of 0.1 to 5 parts by weight per 100 parts by weight of the binder resin, wherein said coloring agent is added in amount of 1 to 20 parts by weight per 100 parts by weight of the binder resin.

8. A method of claim 4 wherein said toner further comprises a metal complex of salicylic acid compound as a charge control agent which is added in amount of 0.1 to 5 parts by weight per 100 parts by weight of the binder resin, and said coloring agent is added in amount of 1 to 20 parts by weight per 100 parts by weight of the binder resin.

9. A method of claim 4 wherein said toner further comprises a calix arene compound as a charge control agent which is added in amount of 0.1 to 5 parts by weight per 100 parts by weight of the binder resin, and said coloring agent is added in amount of 1 to 20 parts by weight per 100 parts by weight of the binder resin.

10. A method of claim 4 wherein said toner further comprises a boron compound as a charge control agent which is added in amount of 0.1 to 5 parts by weight per 100 parts by weight of the binder resin, and said coloring agent is added in amount of 1 to 20 parts by weight per 100 parts by weight of the binder resin.

11. A method for producing a toner for electrostatic latent image developing comprising the steps of:

a. forming a colored resin solution comprising a binder resin, a non-water soluble organic solvent and a coloring agent selected from the group consisting of C. I. Pigment Blue 15-3, C. I. Pigment Red 122 and C. I. Pigment Yellow 17;

b. preparing an aqueous solution including a water and non-water soluble dispersion stabilizer;

c. dispersing the colored resin solution in the aqueous solution to form emulsion particles of the colored resin solution;

d. removing the non-water soluble organic solvent from the emulsion particles to form colored resin particles; and e. removing the water component from the emulsion particles to form colored resin particles.

12. A method of claim 11 wherein said non-water soluble organic solvent is selected from the group consisting of an aromatic organic solvent and a halogenated hydrocarbon organic solvent.

13. A method of claim 11 wherein said non-water soluble dispersion stabilizer is calcium phosphate compound.

14. A method of claim 11 further comprises a step of removing non-water soluble dispersion stabilizer.

15. A method of claim 11 wherein said binder resin is a polyester resin having a glass transition point Tg of 50° to 70° C., a numerical average molecular weight Mn of 2,500 to 12,000, a molecular weight distribution represented by a ratio of weight average molecular weight Mw to Mn (Mw/Mn) of 2 to 6.

16. A method of claim 11 wherein said toner further comprises a boron compound as a charge control agent which is added in amount of 0.1 to 5 parts by weight per 100 parts by weight of the binder resin, and said coloring agent is added in amount of 1 to 20 parts by weight per 100 parts by weight of the binder resin.

17. A method for producing a toner for electrostatic latent image developing comprising the steps of:

a. forming a colored resin solution comprising a binder resin, a non-water soluble organic solvent and a coloring agent, said binder resin comprising a polyester resin having a glass transition point Tg of 50° to 70° C., a numerical average molecular weight Mn of 2,500 to 12,000 and a molecular weight distribution represented by a ratio of weight average molecular weight Mw to Mn (Mw/Mn) of 2 to 6;

b. preparing an aqueous solution including a water and non-water soluble dispersion stabilizer;

c. dispersing the colored resin solution in the aqueous solution to form emulsion particles of the colored resin solution;

d. removing the non-water soluble organic solvent from the emulsion particles to form colored resin particles; and e. removing the water component from the emulsion particles to form colored resin particles.

18. A method of claim 17 wherein said non-water soluble organic solvent is selected from the group consisting of an aromatic organic solvent is selected from the group consisting of an aromatic organic solvent and a halogenated hydrocarbon organic solvent.

19. A method of claim 17 wherein said non-water soluble dispersion stabilizer is calcium phosphate compound.

20. A method of claim 17 wherein said toner further comprises a charge control agent selected from the group consisting of a metal complex of salicylic acid compound, a calix arene compound and a boron containing compound, said charge control agent being added in an amount of 0.1 to 5 parts by weight per 100 parts by weight of the binder resin, and said coloring agent being added in amount of 1 to 20 parts by weight per 100 parts by weight of the binder resin.

* * * * *